United States Patent [19]

Jacobs

[11] 4,274,632

[45] Jun. 23, 1981

[54] SUPPORTING MEANS FOR NETS AND THE LIKE FOR SPORTING ACTIVITIES

[76] Inventor: Brian J. Jacobs, 34 Patty St., Mentone, Victoria, Australia, 3194

[21] Appl. No.: 953,744

[22] Filed: Oct. 23, 1978

[51] Int. Cl.[3] ..... A63B 69/00

[52] U.S. Cl. ..... 273/29 BC

[58] Field of Search ..... 223/29 B, 29 BA, 29 BC, 223/30, 29 R, 127 B, 127 C, 26 B; 273/29 R, 29 A, 29 BA, 29 BC, 29 B, 411; 272/1 B, 390, 391

[56] References Cited

U.S. PATENT DOCUMENTS

| | | | |
|---|---|---|---|
| 3,195,898 | 7/1965 | Respini | 273/26 A |
| 3,754,760 | 8/1973 | Nielson | 273/30 |
| 3,945,641 | 3/1976 | Carbonero | 273/29 BC |
| 4,010,951 | 3/1977 | Grunlund | 273/29 BC |

FOREIGN PATENT DOCUMENTS

| | | | |
|---|---|---|---|
| 2533966 | 2/1977 | Fed. Rep. of Germany | 273/29 BF |

*Primary Examiner*—Richard C. Pinkham
*Assistant Examiner*—T. Brown
*Attorney, Agent, or Firm*—Finnegan, Henderson, Farabow, Garrett & Dunner

[57] ABSTRACT

The invention relates to a portable net supporting apparatus having a pair of substantially upright net supporting posts held in predetermined spaced relationship by a rigid rod-like member which may be laid on the floor or ground. A net or the like is attached between the tops of the posts and when strained causes the posts to flex whereby the net cord is held taut. Lateral supporting legs attached to the posts prevent the net from falling over such as when struck by a ball.

7 Claims, 14 Drawing Figures

SUPPORTING MEANS FOR NETS AND THE LIKE FOR SPORTING ACTIVITIES

This invention relates to supporting means for nets and the like for sporting activities and refers more particularly to such a supporting means which is readily portable.

Tennis and like games nets generally are required to be erected on prepared sites wherein fixed supporting posts or suitable post holding means are provided in the ground or floor of the court or the like.

It is an object of the present invention to provide a portable assembly for supporting a net or the like for sporting activities either indoors or otherwise without the necessity for securing the supports to the floor, walls or ground.

Accordingly, the present invention resides in supporting means for nets and the like for sporting activities comprising a substantially U shaped frame member having a cord or the like extending substantially longitudinally across said frame and being connected thereto at or near the ends of said frame, said frame being so designed and constructed as to impart tension to said cord whereby said cord is maintained taut, stabilizing means attached to or integral with said frame for supporting said frame against tilting in a direction transversely of the longitudinal axis of said frame.

More particularly, the frame comprises supporting means as claimed in claim 1 wherein said frame comprises a pair of substantially upright posts and one or a plurality of rigid longitudinal members interconnectible end to end forming a rigid spacing member for retaining the posts in predetermined spaced relationship, said rigid spacing member being attached to said posts at or near the base of each said post.

Figures 1, 2, 3, 4, 5:
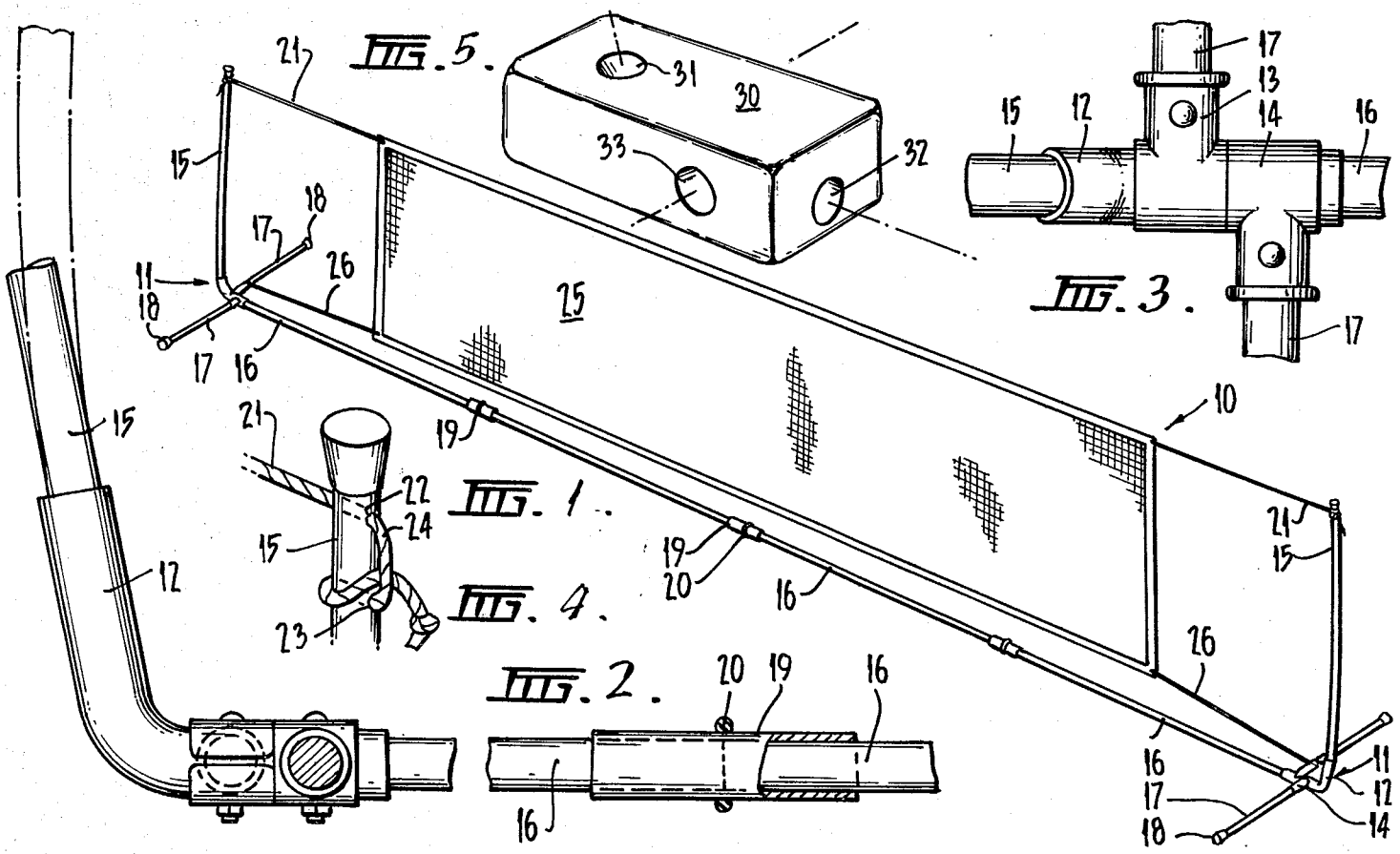
Figure 6:
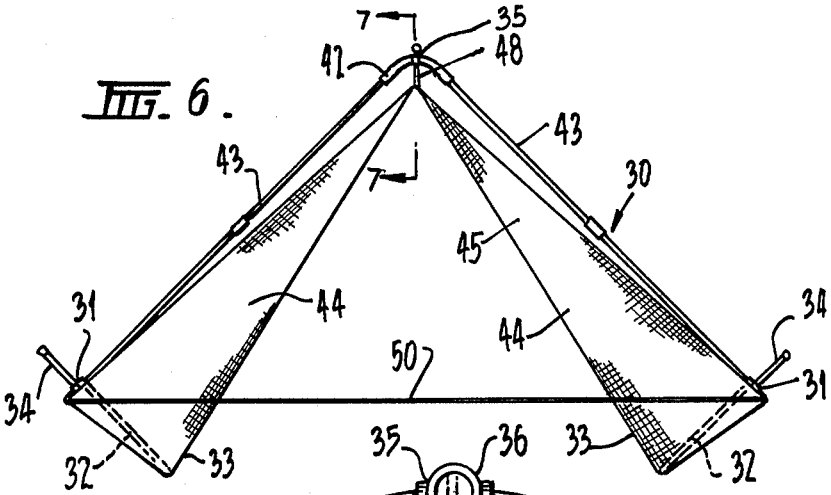
Figure 8:
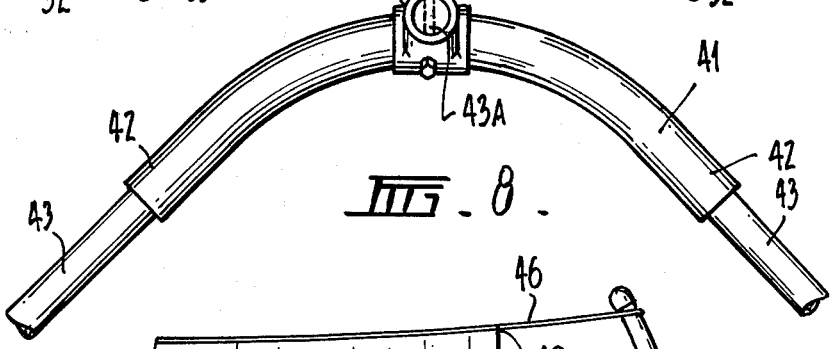
Figure 7:
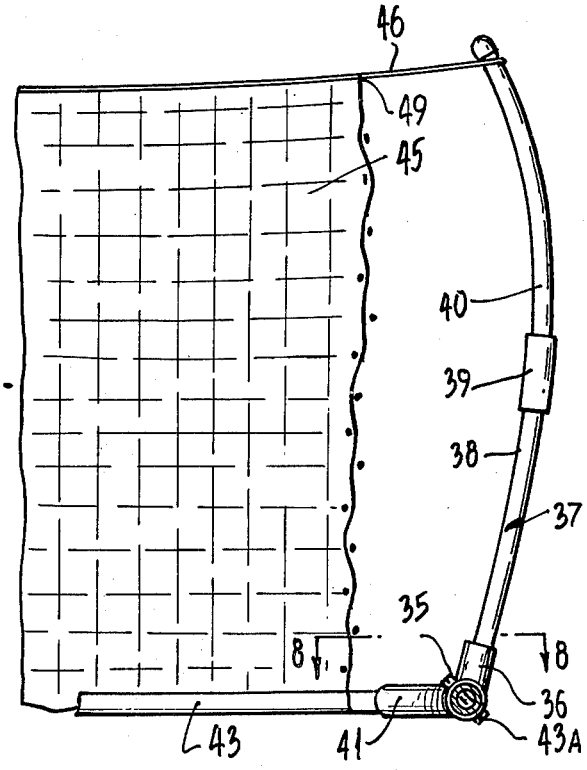
Figures 9, 10:
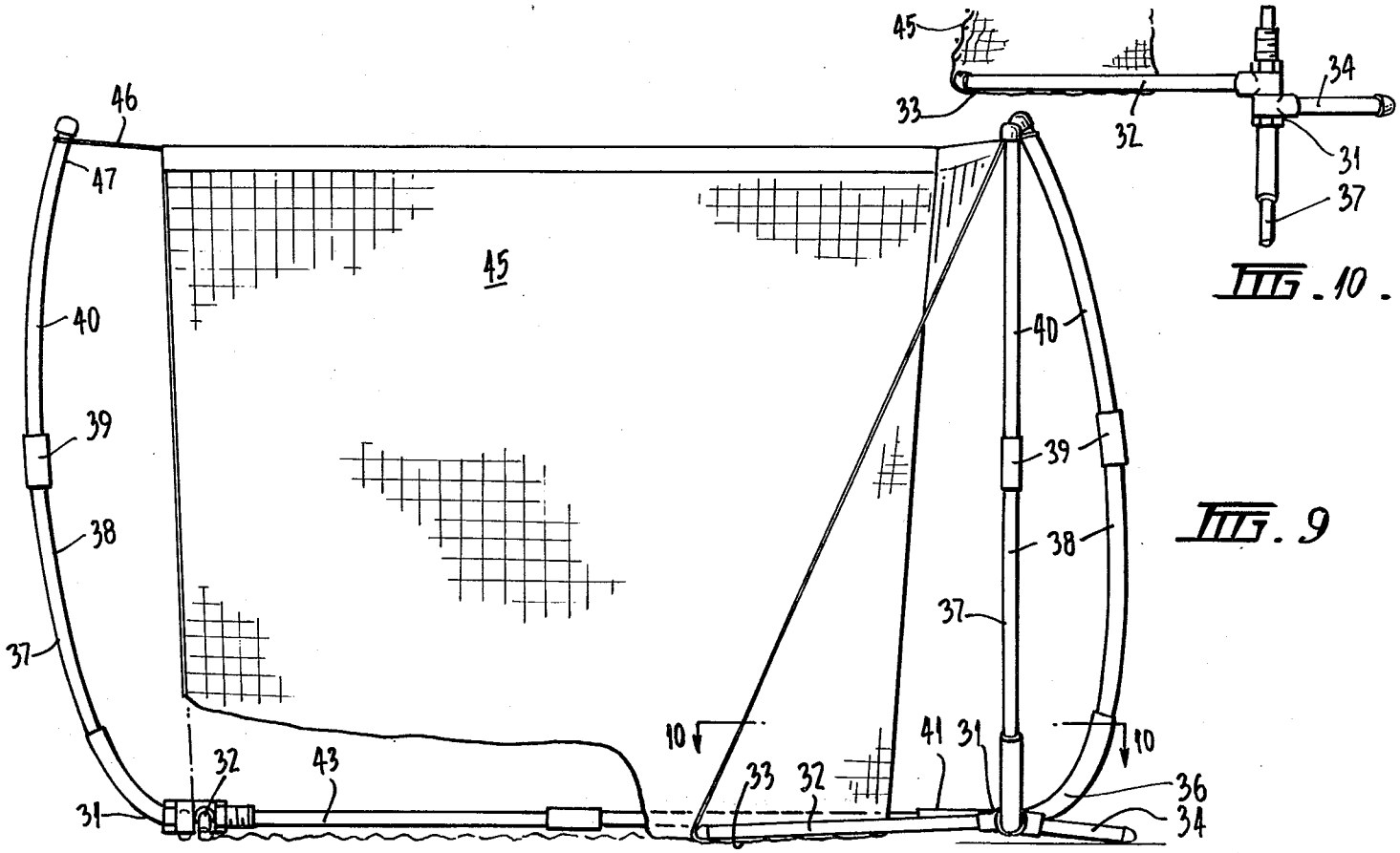

Other features of the invention will become apparent from the following description of preferred embodiments of the invention wherein reference is made to the accompanying drawings in which FIG. 1, is a perspective view of an assembly in accordance with one form of the invention, FIG. 2, is an elevational view of a post supporting member and spacing member, FIG. 3, is a plan view of the member of FIG. 2, FIG. 4, is an enlarged view showing the manner of attachment of the net cord to the post, FIG. 5, is a perspective view of a post supporting member according to another embodiment of the invention, FIG. 6, is a plan view of a net assembly applicable to the practice of games such as cricket, FIG. 7, is an elevational view taken along line 7—7 of FIG. 6, FIG. 8, is a plan view taken along line 8—8 of FIG. 7, FIG. 9, is an elevational view taken in the direction of the arrow 9 of FIG. 6, FIG. 10, is a plan view taken along line 10—10 of FIG. 9, and FIGS. 11 to 14, are schematic views of further modifications of the invention.

The assembly 10 illustrated in the drawings comprises a pair of identical net post supports 11 which according to FIGS. 1 to 3 may be formed by suitably bending and joining tubular members 12, 13 and 14. The tube 12 is bent to an angle of between 90° and 120° and preferably defines an included angle of approximately 95°. The angle is dependent upon several factors such as the type of net to be supported, the flexibility of the posts and the height of the net.

The upturned portion of each tubular member 12 receives and retains a net post 15 and the horizontal portion receives and retains a spacing bar or rod 16. Each member 13, 14 is adapted to receive and retain a supporting leg 17 for preventing the assembly from tilting laterally. The outer or free ends of the legs 17 are provided with rubber feet 18 so as to avoid marking or scratching of a floor or the like.

Members 13, 14 may be formed integrally with the member 12 but preferably they are pipe couplings 13, 14 or the like which permit the legs 17 to be angularly adjusted about the member 12. Such adjustment may be necessary if, for instance the ground is uneven or legs 17 of different lengths are to be utilized to provide greater stability or for a variety of other reasons.

Each spacing bar or rod 16 is provided at one end with a socket 19 adapted to receive the other end of a similar rod. The length and number of rods 16 is dependent upon the game to be played such as tennis, volley ball, badminton etc. and sets of rods 16 are provided for each net game. Similarly the length of each net post 15 is dependent upon the purpose of the net and accordingly the appropriate post length is to be selected.

According to a modification of the invention, (not illustrated) multi-purpose net posts may be provided, the posts being provided with holes at various heights whereby the net cord may be passed therethrough at the desired setting. In this way the one pair of posts would be adaptable for all games.

The sockets 19 of the rods 16 are provided with rubber or like rings 20 to avoid marking a floor. Alternatively the sockets 19 may be separate members which may be slipped onto the adjoining rods simply to prevent said rods from moving out of alignment. The sockets and/or the rods 16 may be coated with plastic material.

As shown in FIG. 5 a post supporting member 30 which may be made of fibreglass, wood or other suitable material, is provided with a hole or socket 31 for receiving and retaining a net post 15, a hole or socket 32 for receiving and retaining a spacing rod 16 and a pair of holes or sockets 33 for receiving and retaining supporting legs 17. The hole or socket 31 is formed at an angle of between 90° and 120°, and is preferably 95° with respect to the base of the block. The holes or sockets 33 are also preferably slightly angled outwardly and downwardly so that when the supporting legs 17 are inserted therein the outer ends or feet 18 of said legs rest firmly on the floor or the ground.

When it is desired to assemble the members such as in preparation for a game of tennis the post supporting members 11 have the legs 17 inserted into the tubes 13, 14 and the rods 16 are interconnected end to end as hereinbefore described and the opposite ends are inserted into the tube 12 of each member 11. Thus, the post supporting members are rigidly spaced apart at opposite sides of the court and are firmly supported against lateral tilting by means of the transverse legs 17.

The net posts 15 are then inserted into the upward tubular portion 12 of each member 11 and at this stage because there is no strain on the posts they are inclined outwardly of the court at an angle of approximately 95°. The net cord 21 is attached to one of the posts 15 by passing the cord through a hole 22 in the post 15 then returning the cord through an adjacent hole 23 so that a small loop 24 is formed. A knot is tied at or near the end of the cord and the end of the cord is passed through the loop 24. The cord is then pulled taut to prevent the knotted end of the cord from being withdrawn through the loop 24.

The net 25 is strung across the court and the net cord 21 is attached to the opposite net post 15 in the manner described. The net is strained to the desired height by pulling the cord 21 through the holes 22, 23 in the post 15 and as the net is strained the posts 15 are pulled inwardly towards each other slightly thereby tending to straighten the posts from their outwardly inclined attitude to a substantially vertical position. The tendency for the posts to return to their initial attitude due to their resilience, imparts a constant strain to the net thereby keeping the net taut at the desired height.

The net base cord 26 is attached to the members 11 thus completing the net assembly.

The assembly 30 illustrated in FIGS. 6 to 10 of the drawings comprises a pair of identical net post supports 31 as previously described with the possible exception that the supports of this embodiment have a relatively long leg 32 facing inwardly of the net assembly 30 said legs 32 being adapted (if necessary) to clamp the bottom edge 33 of the net against the ground. The other leg 34 of each support member may be relatively short. The post supports 31 are situated at the outer or free ends of the assembly 30 (See FIG. 6). The legs 32, 34 are angularly adjustable as hereinbefore described.

An intermediate post support 35 as illustrated most clearly in FIG. 8 is interposed between said members 31 such as to provide an assembly which when viewed in plan (FIG. 6) an angled net assembly is provided. Such an assembly is ideal as a practice net for cricket or the like, the stumps being situated within the area of the assembly.

As will be seen from the drawings each post support includes a socket 36 within which a post 37 may be inserted. The sockets 36 are preferably angled upwardly and outwardly of the assembly so that the posts 37 when in unstressed condition are similarly angled upwardly and outwardly. The height of the posts 37 is preferably adjustable by providing the lower part 38 of the two-part post with a sleeve or socket 39 adapted to receive an upper part 40 of said post.

The intermediate post support 35 includes a post support socket 36 as hereinbefore described and an arcuate ground engaging member 41 which is hollow or has a sleeve or socket 42 into which rigid spacing rods 43 may be inserted. The socket 36 is adjustable through a vertical plane whereby the angle of the post may be altered. A locking pin 43A or the like retains the post in the desired position. The length and/or number of rods 43 is dependent upon the purpose for which the assembly is to be used and the length of each wing 44 of the net assembly may be varied as required.

The assembly is completed by erecting a net 45 by attaching the top cord 46 of the net to the top 47 of each end post 37 and tucking the bottom edge 33 of the net 45 under the long legs 32 of the post support members. The net 45 may be attached to the top of the intermediate or corner-angle post by means of an additional cord 48. Alternatively, the net cord binding may be provided with a reinforced opening 49 enabling the cord 46 to be pulled through for attachment to the post (See FIG. 7). A cord 50 is tied between the tops of the end posts 37 to provide additional stability to the assembly.

As illustrated schematically in FIGS. 11 to 14 the assembly may be applied to a wide variety of sporting activities.

Figure 11:
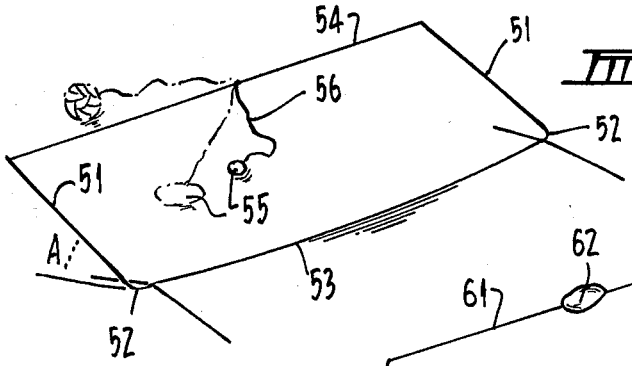

According to the embodiment illustrated in FIG. 11, a pair of posts 51 and support members 52 of the kind hereinbefore described are retained in spaced relationship by means of a spacing rod or rods 53. As shown in FIG. 11, the posts 51 are arranged to define an acute angle A with the ground. A taut cord 54 is attached to the top of each post 51 whereby the assembly provides strong but highly flexible support for a ball 55 or the like which is attached to the cord 54 by means of a cord 56 or the like.

The assembly may thus be used for practising tennis strokes or the like or for practising kicking, marking, heading etc. of footballs.

Figure 12:
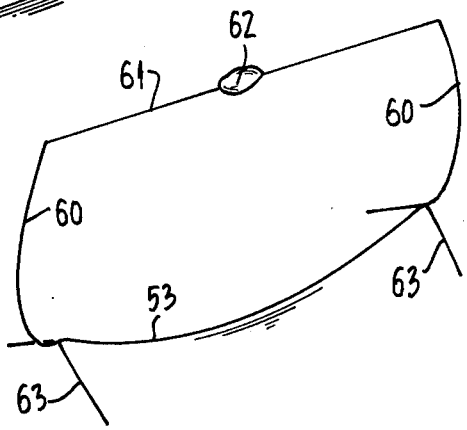

As will be seen from FIG. 12 the support posts 60 arranged substantially as for supporting a net have a taut cord 61 attached between the tops of said posts 60 and a boxing speed-ball 62 is mounted in-line on said cord 61. The height of the posts 60 may be adjusted as required by altering the angular adjustments of the stabilizing legs 63 and/or by altering the angle of the posts and/or by lengthening or shortening said posts.

Figure 13:
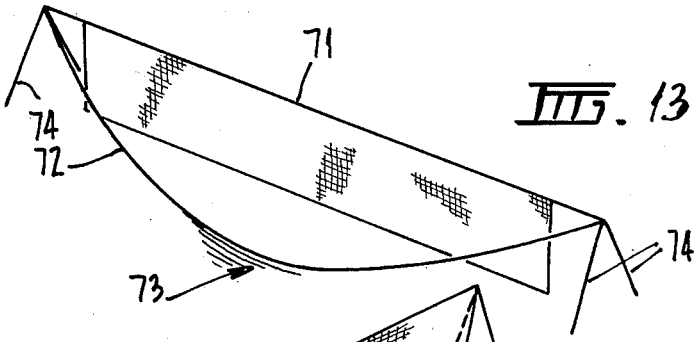

Referring more particularly to FIG. 13 the net cord 71 is attached to the ends of a rod 72 of fiberglass or the like which has been bent to form a bow-like frame 73. Depending upon the resilience of the fiberglass some adjustment of tension of the cord may be necessary. The ends of the rod are provided with a connecting member which may be a moulded unit having recesses or sleeves for receiving the end of said rod 72 and downwardly and outwardly depending support legs 74 for preventing sideways tilting of the unit.

Figure 14:
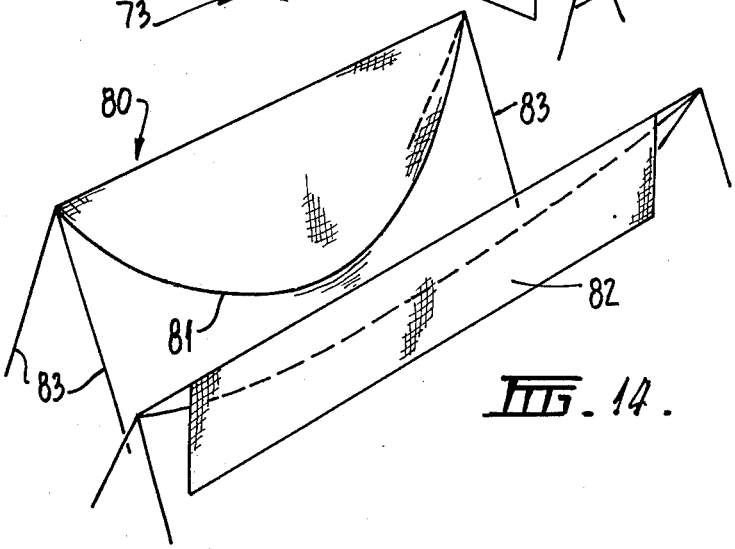

As shown in FIG. 14, it is possible to use two nets in combination for the practice of games such as tennis, squash or the like. In this particular embodiment the rear net 80 is tied to the bow-like frame 81 to thereby form a tight net construction such as to cause a ball to rebound therefrom. Alternatively, the lower net 82 may be dispensed with altogether.

By adjustment of the angle and/or the length of the legs 83, the net may be angularly adjusted. It may for example, be moved from a substantially vertical plane to a substantially horizontal plane. Thus depending upon the intended use of the net it may be adjusted through a number of positions to positions such as to cause a ball to rebound high into the air or directly down onto the ground.

It will thus be seen that the present invention may be adapted to the practice of many sporting activities and for playing net games such as tennis, badminton, volley ball or the like, there being no necessity to prepare the court area or provide any floor or wall attachments.

I claim:

1. A free standing net support for sporting activities comprising a pair of substantially upright posts, a post support receiving each of said posts, rigid spacing means received in said post supports adjacent the base thereof and retaining said posts in a predetermined spaced relationship, said spacing means adapted to rest on a surface, a pair of legs attached to each support and extending laterally to opposite sides of each of said supports and of said spacing means, said legs being angularly adjustable relative to said supports, said posts being angled upwardly relative to said surface and outwardly from each other and being resilient and adapted to be pulled into a substantially vertical position when a net cord is attached thereto and strained, said laterally extending legs preventing tilting of said net support in a direction transverse to the plane of said net.

2. A net support as claimed in claim 1, said spacing means including a plurality of elongated members interconnected end to end.

3. A net support as claimed in claim 1, said angularly adjustable legs being detachable from said supports and replaceable by legs of a different length whereby the net support can be adapted for firm support on a variety of surfaces.

4. A net support as claimed in claim 1 including means for adjusting the net in a vertical plane.

5. A net support as claimed in claim 1, said posts and said spacing means when received in said post supports defining an included angle of between 90° and 120° when unstrained.

6. A net support as claimed in claim 1, said posts and said spacing member when received in said post supports defining an included angle of 95°.

7. A net support as claimed in claim 1, said post supports, said spacing means and said adjustable legs forming a five point contact with the surface.

* * * * *

UNITED STATES PATENT AND TRADEMARK OFFICE

CERTIFICATE OF CORRECTION

PATENT NO. : 4,274,632

DATED : June 23, 1981

INVENTOR(S) : BRIAN JAMES JACOBS

It is certified that error appears in the above—identified patent and that said Letters Patent is hereby corrected as shown below:

On the title page

The following foreign priority information should be inserted:

[30] Foreign Application Priority Data

| | |
|---|---|
| Oct. 21, 1977 | Australia.....PD 2141 |
| July 6, 1978 | Australia.....PD 4983 |

Signed and Sealed this

Sixteenth Day of November 1982

[SEAL]

Attest:

GERALD J. MOSSINGHOFF

Attesting Officer

Commissioner of Patents and Trademarks